US011858719B2

(12) United States Patent
Gonzalez et al.

(10) Patent No.: US 11,858,719 B2
(45) **Date of Patent: *Jan. 2, 2024**

(54) WIRE AND CABLE PACKAGE

(71) Applicant: Southwire Company, LLC, Carrollton, GA (US)

(72) Inventors: Juan Alberto Galindo Gonzalez, Powder Springs, GA (US); Richard Mike Temblador, Carrollton, GA (US); Laurentiu Dan Dragomir, Atlanta, GA (US); Allan W. Daniel, Woodland, AL (US); James Phillip Tuggle, Carrollton, GA (US)

(73) Assignee: Southwire Company, LLC, Carrollton, GA (US)

( * ) Notice: Subject to any disclaimer, the term of this patent is extended or adjusted under 35 U.S.C. 154(b) by 205 days.

This patent is subject to a terminal disclaimer.

(21) Appl. No.: 17/463,642

(22) Filed: Sep. 1, 2021

(65) Prior Publication Data

US 2021/0394998 A1 Dec. 23, 2021

Related U.S. Application Data

(63) Continuation of application No. 14/077,998, filed on Nov. 12, 2013, now Pat. No. 11,117,737.

(Continued)

(51) Int. Cl.

*B65D 85/04* (2006.01)
*B65H 75/16* (2006.01)

(Continued)

(52) U.S. Cl.

CPC ..... *B65D 85/04* (2013.01); *B65H 49/08* (2013.01); *B65H 57/18* (2013.01); *B65H 75/16* (2013.01);

(Continued)

(58) Field of Classification Search

None

See application file for complete search history.

(56) References Cited

U.S. PATENT DOCUMENTS 302,461 A 7/1884 Woecestee
897,822 A 9/1908 Dougherty (Continued)

FOREIGN PATENT DOCUMENTS

AR 093458 B1 4/2019
CN 101200250 A 6/2008

(Continued)

OTHER PUBLICATIONS

Reelex Packaging Solutions; Tangle and Twist-Free Packaging. Printed Oct. 17, 2013. http://www.reelex.com/Packaging/index.html. (3 pages).

(Continued)

*Primary Examiner* — William A. Rivera

(74) *Attorney, Agent, or Firm* — Merchant & Gould P.C.

(57) ABSTRACT

Consistent with embodiments of the invention, a cable package may be provided. The cable package may comprise a cable and a chamber. The cable may comprise a winding and at least one free end. The chamber may define an internal volume containing the cable. The chamber may comprise a continuous opening. The continuous opening may comprise at least one surface arranged to apply pressure to a portion of the cable located proximate to the continuous opening.

14 Claims, 10 Drawing Sheets

Related U.S. Application Data

(60) Provisional application No. 61/776,323, filed on Mar. 11, 2013, provisional application No. 61/725,227, filed on Nov. 12, 2012.

(51) Int. Cl.
*B65H 49/08* (2006.01)
*B65H 57/18* (2006.01)

(52) U.S. Cl.
CPC .... *B65H 2701/34* (2013.01); *B65H 2701/534* (2013.01)

(56) References Cited

U.S. PATENT DOCUMENTS 1,836,593 A 12/1931 Harvey
2,029,975 A 2/1936 Winchester
2,031,851 A 2/1936 Plunkett
2,161,546 A 6/1939 Honig
2,200,140 A 5/1940 Willeke et al.
2,268,554 A 1/1942 Abbott
2,300,243 A 10/1942 Zierden
2,365,115 A 12/1944 Siegenthaler
2,408,552 A 10/1946 Gammeter
2,418,413 A 4/1947 Lance
2,533,731 A 12/1950 Gomberg
2,609,159 A 9/1952 Nye
2,620,997 A 12/1952 Lyon
2,694,535 A 11/1954 Atti
2,744,692 A 5/1956 Phillips et al.
2,826,372 A 3/1958 Hurst et al.
2,845,229 A 7/1958 Bliss
2,869,719 A 1/1959 Hubbard
2,894,147 A 7/1959 Stidwill
2,901,190 A 8/1959 Wentz
2,943,732 A 7/1960 Kovaleski et al.
2,966,935 A 1/1961 Wiltshire
2,975,987 A 3/1961 Strickland et al.
2,988,292 A 6/1961 Bliss
2,996,170 A 8/1961 Bruestle
3,000,493 A 9/1961 Hirst
3,082,868 A 3/1963 Hubbard
3,111,279 A 11/1963 Daley et al.
3,112,234 A 11/1963 Krupp
3,114,456 A 12/1963 Van Billiard
3,114,665 A 12/1963 Wiltshire
3,133,236 A 5/1964 Mccauley
3,140,058 A 7/1964 Courtney
3,144,952 A 8/1964 Uhlig et al.
3,157,520 A 11/1964 Hoeppel et al.
3,175,679 A 3/1965 Bratz
3,185,299 A 5/1965 Trainer
3,208,121 A 9/1965 Price
3,210,228 A 10/1965 Bluck
3,224,690 A 12/1965 Holman
3,228,549 A 1/1966 Courtney
3,232,545 A 2/1966 Ross et al.
3,237,657 A 3/1966 Elvers et al.
3,253,800 A 5/1966 Whitacre
3,258,379 A 6/1966 Ponemon et al.
3,276,936 A 10/1966 Uhlig et al.
3,278,136 A 10/1966 Rosen
3,300,356 A 1/1967 Warnken et al.
3,301,393 A 1/1967 Regan, Jr. et al.
3,308,937 A 3/1967 Rosen
3,310,246 A 3/1967 Mcclean
3,317,146 A 5/1967 Holman
3,319,070 A 5/1967 Schneider
3,319,781 A 5/1967 Simpson et al.
3,331,722 A 7/1967 Ponemon
3,333,778 A 8/1967 Levenetz et al.
3,334,824 A 8/1967 Mcclean
3,352,412 A 11/1967 Draving et al.
3,367,586 A 2/1968 Eshbaugh
3,367,815 A 2/1968 Ragettli et al.
3,378,215 A 4/1968 Wilson
3,380,675 A 4/1968 Baxter, Jr. et al.
D211,609 S 7/1968 Braken
3,390,844 A 7/1968 Dillow et al.
3,391,873 A 7/1968 Hardesty
3,406,817 A 10/1968 Lane et al.
3,414,449 A 12/1968 Beach
3,430,886 A 3/1969 Sweeney
3,451,633 A 6/1969 Markham et al.
3,472,364 A 10/1969 Sloan
3,495,703 A 2/1970 Calabrese
3,507,458 A 4/1970 White et al.
3,512,635 A 5/1970 Lang
3,515,269 A 6/1970 Furtado
3,520,494 A 7/1970 Anderson et al.
3,549,454 A 12/1970 Roberts
3,565,213 A 2/1971 Heller
3,585,705 A 6/1971 Allan
3,589,740 A 6/1971 Beach
3,593,943 A 7/1971 Collmann
3,602,455 A 8/1971 Lewis
3,606,197 A 9/1971 Akers
3,610,549 A 10/1971 Wennerstrom et al.
3,648,949 A 3/1972 Berger et al.
3,675,864 A 7/1972 Eschenbach
3,675,865 A 7/1972 Eschenbach
3,677,483 A 7/1972 Werner
3,681,905 A 8/1972 Furtmeier et al.
3,700,185 A 10/1972 Hubbard
3,722,825 A 3/1973 Phillips et al.
3,727,851 A 4/1973 Beninati et al.
3,727,858 A 4/1973 Cornwell et al.
3,731,793 A 5/1973 Hagel
3,741,357 A 6/1973 Krysiuk et al.
3,753,342 A 8/1973 Yoshitake et al.
3,782,097 A 1/1974 Nakamura et al.
3,804,131 A 4/1974 Holmes et al.
3,814,348 A 6/1974 Johnson
3,819,847 A 6/1974 Charles
3,853,223 A 12/1974 Nowlain
3,866,849 A 2/1975 Eschenbach
3,876,167 A 4/1975 Nittschalk et al.
3,907,228 A 9/1975 Lewis
3,935,699 A 2/1976 Iida et al.
3,945,578 A 3/1976 Kaminsky et al.
3,951,349 A 4/1976 Christensen et al.
3,967,787 A 7/1976 Mulleman
4,004,744 A 1/1977 Hoorelbeke
4,005,233 A 1/1977 Dritt et al.
4,015,416 A 4/1977 Mori et al.
4,015,795 A 4/1977 Chong
4,022,391 A 5/1977 Stein et al.
4,023,338 A 5/1977 Tooka et al.
4,026,483 A 5/1977 Skalleberg
4,050,640 A 9/1977 Henrich
4,050,641 A 9/1977 Henrich
4,083,506 A 4/1978 Mander et al.
4,098,468 A 7/1978 Skalleberg
4,129,158 A 12/1978 Schmid
4,157,165 A 6/1979 Bierman et al.
4,157,791 A 6/1979 Meister
D253,349 S 11/1979 Jennings
4,186,897 A 2/1980 Brown
4,196,575 A 4/1980 Novak
4,202,509 A 5/1980 Horn
4,207,927 A 6/1980 Camardella
RE30,489 E 1/1981 Abbott
4,244,536 A 1/1981 Harrill
4,323,408 A 4/1982 Dana et al.
4,360,871 A 11/1982 Blaney
4,369,621 A 1/1983 Kogiso
4,371,308 A 2/1983 Skalleberg
4,389,838 A 6/1983 Adelhard et al.
4,417,698 A 11/1983 Pernet et al.
4,423,360 A 12/1983 Pasterkamp
4,469,285 A 9/1984 Fahrbach
4,520,239 A 5/1985 Schwartz
4,557,788 A 12/1985 Dana et al.
4,586,669 A 5/1986 Smith

(56) References Cited

U.S. PATENT DOCUMENTS

| | | | |
|---|---|---|---|
| 4,607,803 | A | 8/1986 | Nozawa |
| 4,609,160 | A | 9/1986 | Linderoth et al. |
| 4,616,469 | A | 10/1986 | Skalleberg |
| 4,630,652 | A | 12/1986 | Dieterich |
| 4,631,101 | A | 12/1986 | Rix |
| 4,634,076 | A | 1/1987 | Eckert et al. |
| 4,637,516 | A | 1/1987 | De Roure |
| 4,643,305 | A | 2/1987 | De Roure |
| 4,653,833 | A | 3/1987 | Czubernat et al. |
| D289,492 | S | 4/1987 | Clivio et al. |
| 4,656,320 | A | 4/1987 | Maddock |
| 4,664,260 | A | 5/1987 | Stokes |
| 4,685,636 | A | 8/1987 | Eaton |
| 4,723,405 | A | 2/1988 | Shinkai et al. |
| 4,750,247 | A | 6/1988 | Anahara et al. |
| 4,769,982 | A | 9/1988 | Kogiso et al. |
| 4,826,100 | A | 5/1989 | Belliveau |
| 4,846,343 | A | 7/1989 | Rupert |
| 4,846,910 | A | 7/1989 | Brown |
| 4,848,697 | A | 7/1989 | Skalleberg |
| 4,866,814 | A | 9/1989 | Carbonetto |
| 4,869,367 | A | 9/1989 | Kawasaki et al. |
| 4,872,551 | A | 10/1989 | Theros |
| 4,901,516 | A | 2/1990 | Vignon |
| 4,913,369 | A | 4/1990 | Lia et al. |
| 4,984,685 | A | 1/1991 | Douglas |
| 4,998,685 | A | 3/1991 | Spencer |
| 5,007,594 | A | 4/1991 | Brown |
| 5,014,925 | A | 5/1991 | Cump |
| 5,052,632 | A | 10/1991 | Stokes |
| 5,062,580 | A | 11/1991 | Meagher |
| 5,067,204 | A | 11/1991 | Shinkai et al. |
| 5,078,332 | A | 1/1992 | Carter |
| 5,083,719 | A | 1/1992 | Kremar |
| 5,107,961 | A | 4/1992 | Schott |
| 5,117,621 | A | 6/1992 | Feichtinger et al. |
| 5,123,602 | A | 6/1992 | Skalleberg et al. |
| 5,129,516 | A | 7/1992 | Theros |
| 5,133,509 | A | 7/1992 | Brown |
| 5,139,210 | A | 8/1992 | Schaffer |
| 5,209,414 | A | 5/1993 | Clemens et al. |
| 5,255,863 | A | 10/1993 | Horndler |
| 5,263,228 | A | 11/1993 | Shinkai et al. |
| 5,267,705 | A | 12/1993 | Hofrichter et al. |
| 5,277,314 | A | 1/1994 | Cooper et al. |
| 5,294,068 | A | 3/1994 | Baro et al. |
| 5,313,131 | A | 5/1994 | Hibino et al. |
| 5,326,292 | A | 7/1994 | Brushaber |
| 5,331,799 | A | 7/1994 | Weeger |
| D351,561 | S | 10/1994 | Moffatt et al. |
| D352,449 | S | 11/1994 | Rosine |
| D358,599 | S | 5/1995 | Dietterich et al. |
| D360,530 | S | 7/1995 | Bobeczko |
| 5,439,184 | A | 8/1995 | Poppinghaus et al. |
| 5,441,584 | A | 8/1995 | Mathieu et al. |
| 5,490,595 | A | 2/1996 | Sakai et al. |
| 5,499,775 | A | 3/1996 | Vander Groef |
| D370,626 | S | 6/1996 | Pass et al. |
| 5,551,644 | A | 9/1996 | Linderoth |
| D374,166 | S | 10/1996 | Czerwinski et al. |
| 5,698,067 | A | 12/1997 | Packard |
| 5,702,066 | A | 12/1997 | Hurst et al. |
| 5,713,528 | A | 2/1998 | Pohn |
| 5,727,744 | A | 3/1998 | Threlkeld et al. |
| 5,738,209 | A | 4/1998 | Burr et al. |
| 5,758,834 | A | 6/1998 | Dragoo et al. |
| 5,829,705 | A | 11/1998 | Carlberg |
| 5,843,543 | A | 12/1998 | Mathieu et al. |
| D404,286 | S | 1/1999 | Plantz et al. |
| 5,881,967 | A | 3/1999 | Dawson et al. |
| 5,921,391 | A | 7/1999 | Ortiz et al. |
| 5,957,282 | A | 9/1999 | Juszkiewicz et al. |
| 5,979,760 | A | 11/1999 | Freyman |
| 5,992,787 | A | 11/1999 | Burke |
| 6,062,386 | A | 5/2000 | Inoue et al. |
| 6,062,506 | A | 5/2000 | Eck et al. |
| 6,086,009 | A | 7/2000 | Skalleberg et al. |
| 6,109,005 | A | 8/2000 | Fogle |
| D431,179 | S | 9/2000 | Kovacik et al. |
| 6,138,940 | A | 10/2000 | Hurd |
| 6,141,948 | A | 11/2000 | Brazeau |
| 6,145,624 | A | 11/2000 | Tharpe |
| D442,551 | S | 5/2001 | Stekelenburg |
| 6,273,354 | B1 | 8/2001 | Kovacik et al. |
| 6,290,162 | B1 | 9/2001 | Sano et al. |
| 6,296,118 | B1 | 10/2001 | Speck |
| 6,375,113 | B1 | 4/2002 | Ishimaru et al. |
| 6,386,364 | B2 | 5/2002 | Kawasaki et al. |
| 6,390,405 | B1 | 5/2002 | Bissonnette et al. |
| 6,392,846 | B1 | 5/2002 | Brown |
| D464,624 | S | 10/2002 | Shim |
| 6,464,077 | B1 | 10/2002 | Liu |
| 6,483,033 | B1 | 11/2002 | Simoes |
| 6,540,169 | B2 | 4/2003 | Chuang |
| D475,277 | S | 6/2003 | Wu |
| D475,609 | S | 6/2003 | Lin |
| 6,582,514 | B1 | 6/2003 | Yang |
| 6,594,972 | B1 | 7/2003 | Fogle |
| 6,612,515 | B1 | 9/2003 | Tinucci et al. |
| 6,631,864 | B1 | 10/2003 | Skalleberg |
| D481,629 | S | 11/2003 | Milan |
| D484,044 | S | 12/2003 | Milan |
| D485,752 | S | 1/2004 | Milan |
| 6,691,930 | B2 | 2/2004 | Lu |
| 6,715,608 | B1 | 4/2004 | Moore |
| D490,978 | S | 6/2004 | Breyer |
| 6,749,139 | B2 | 6/2004 | Speck |
| D503,882 | S | 4/2005 | Milan |
| D504,606 | S | 5/2005 | Kovacik et al. |
| 6,889,835 | B2 | 5/2005 | Land |
| 6,913,145 | B2 | 7/2005 | Barton et al. |
| 6,938,767 | B2 | 9/2005 | Gelmetti |
| D511,294 | S | 11/2005 | Kovacik et al. |
| 6,966,791 | B1 | 11/2005 | Farr |
| 6,978,962 | B1 | 12/2005 | Fore, Sr. et al. |
| 6,988,854 | B2 | 1/2006 | Porter |
| 7,004,318 | B2 | 2/2006 | Barton |
| D517,909 | S | 3/2006 | Kent et al. |
| 7,032,854 | B2 | 4/2006 | Marsden |
| 7,063,285 | B1 | 6/2006 | Turley et al. |
| D524,643 | S | 7/2006 | Legrand |
| 7,076,985 | B2 | 7/2006 | Rex |
| 7,100,863 | B2 | 9/2006 | Hsu et al. |
| D529,884 | S | 10/2006 | Zernov |
| D537,403 | S | 2/2007 | Villani et al. |
| 7,178,755 | B2 | 2/2007 | Hsu et al. |
| 7,191,968 | B2 | 3/2007 | Kuper |
| 7,198,152 | B2 | 4/2007 | Barton et al. |
| 7,311,285 | B2 | 12/2007 | Rauchs et al. |
| 7,341,214 | B2 | 3/2008 | Taatjes et al. |
| 7,367,452 | B1 | 5/2008 | Hsu |
| 7,370,823 | B2 | 5/2008 | Lammermann et al. |
| 7,398,881 | B2 | 7/2008 | Barton et al. |
| D576,030 | S | 9/2008 | Lee et al. |
| D581,264 | S | 11/2008 | Mapes, Jr. |
| 7,525,230 | B1 | 4/2009 | Gabrys |
| D595,121 | S | 6/2009 | Murphy |
| 7,566,376 | B2 | 7/2009 | Matsuoka |
| D604,244 | S | 11/2009 | Kovacik et al. |
| D605,033 | S | 12/2009 | Iacona |
| D606,856 | S | 12/2009 | Ginsberg et al. |
| D610,771 | S | 2/2010 | Doan |
| 7,654,484 | B2 | 2/2010 | Mogensen |
| 7,665,682 | B2 | 2/2010 | Stahlecker et al. |
| D618,997 | S | 7/2010 | Roesler |
| 7,762,491 | B2 | 7/2010 | Schmalholz |
| 7,792,316 | B2 | 9/2010 | Tan et al. |
| 7,798,326 | B2 | 9/2010 | Hsu |
| 7,938,356 | B2 | 5/2011 | Taatjes et al. |
| 7,987,982 | B2 | 8/2011 | Hsu |
| 8,006,840 | B2 | 8/2011 | Babcock et al. |
| 8,052,078 | B2 | 11/2011 | Deluca et al. |
| 8,157,202 | B2 | 4/2012 | Taatjes et al. |
| 8,230,995 | B2 | 7/2012 | Andrews et al. |

(56) References Cited

U.S. PATENT DOCUMENTS

| | | | | |
|---|---|---|---|---|
| D666,080 | S | 8/2012 | Boehler | |
| 8,359,990 | B2 | 1/2013 | Totsu | |
| 8,398,013 | B2 | 3/2013 | Skalleberg | |
| D720,212 | S | 12/2014 | Gonzalez et al. | |
| D739,448 | S | 9/2015 | Gonzalez et al. | |
| 11,117,737 | B2 * | 9/2021 | Gonzalez | B65H 57/18 |
| 2002/0017475 | A1 | 2/2002 | Speck | |
| 2003/0010662 | A1 | 1/2003 | King | |
| 2003/0010862 | A1 | 1/2003 | Buyce et al. | |
| 2003/0089818 | A1 | 5/2003 | Reau et al. | |
| 2004/0173703 | A1 | 9/2004 | Barton | |
| 2005/0194278 | A1 | 9/2005 | Barton et al. | |
| 2005/0258290 | A1 | 11/2005 | Kuper | |
| 2006/0049294 | A1 | 3/2006 | Thebault et al. | |
| 2006/0196989 | A1 | 9/2006 | Bartley et al. | |
| 2006/0261210 | A1 | 11/2006 | Murphy | |
| 2007/0145176 | A1 | 6/2007 | Fasser et al. | |
| 2007/0189565 | A1 | 8/2007 | Tan et al. | |
| 2008/0142567 | A1 | 6/2008 | Kim et al. | |
| 2009/0057459 | A1 | 3/2009 | Fabian | |
| 2009/0107867 | A1 | 4/2009 | Bang et al. | |
| 2009/0261196 | A9 | 10/2009 | Bender et al. | |
| 2010/0243787 | A1 | 9/2010 | Skalleberg | |
| 2010/0252299 | A1 | 10/2010 | Kummer et al. | |
| 2010/0301155 | A1 | 12/2010 | Widmann | |
| 2010/0314483 | A1 | 12/2010 | Shah et al. | |
| 2011/0085775 | A1 | 4/2011 | Van Zuylen et al. | |
| 2012/0091249 | A1 | 4/2012 | Crossett et al. | |
| 2012/0168554 | A1 | 7/2012 | Blunt et al. | |
| 2013/0320131 | A1 | 12/2013 | Calman et al. | |
| 2014/0203015 | A1 | 7/2014 | Brown et al. | |
| 2014/0252152 | A1 | 9/2014 | Schilling et al. | |
| 2014/0284233 | A1 | 9/2014 | Van Patten et al. | |

FOREIGN PATENT DOCUMENTS

| | | | |
|---|---|---|---|
| CN | 100575766 | C | 12/2009 |
| CO | 30946 | | 2/2017 |
| DE | 7936908 | U1 | 4/1981 |
| DE | 3320250 | A1 | 4/1984 |
| DE | 602013027572.6 | | 10/2017 |
| EP | 0009860 | A1 | 4/1980 |
| EP | 39140 | A1 | 11/1981 |
| EP | 153080 | A2 | 8/1985 |
| EP | 153080 | A3 | 8/1986 |
| EP | 153080 | B1 | 5/1989 |
| EP | 1018479 | A2 | 7/2000 |
| EP | 1018479 | A3 | 1/2001 |
| EP | 1460017 | A1 | 9/2004 |
| EP | 1520683 | A2 | 4/2005 |
| EP | 1520683 | A3 | 10/2005 |
| EP | 1520683 | B1 | 2/2008 |
| EP | 2418413 | A1 | 2/2012 |
| EP | 2917136 | B1 | 10/2017 |
| FR | 2587984 | A1 | 4/1987 |
| FR | 2703030 | A1 | 9/1994 |
| GB | 1069653 | A | 5/1967 |
| JP | 63252883 | A | 10/1988 |
| JP | 63307068 | A | 12/1988 |
| JP | 6321283 | A | 11/1994 |
| JP | 107568 | | 1/1998 |
| JP | 2000142853 | A | 5/2000 |
| JP | 4431351 | B2 | 3/2010 |
| KR | 30-0756837 | | 8/2014 |
| MX | 362619 | | 1/2019 |
| RU | 2065832 | C1 | 8/1996 |
| TW | I657992 | | 5/2019 |
| WO | 9419258 | A1 | 9/1994 |
| WO | 9959898 | A1 | 11/1999 |
| WO | 2005095014 | A1 | 10/2005 |
| WO | 2006132394 | A1 | 12/2006 |
| WO | 2007112477 | A1 | 10/2007 |
| WO | 2010036082 | A2 | 4/2010 |
| WO | 2010058451 | A1 | 5/2010 |

OTHER PUBLICATIONS

Wire coil clamshell package wins DuPont award. Printed Oct. 17, 2013. http://www.healthcarepackaging.com/applications/healthcare/wire-coil-clamshell-package-wins-dupont-award. (2 pages.)

The Optimal Package? Skalek Mini Pac Pure. http:/www.skaltek.se/PDF/MiniPac.pdf (2 pages).

Contractor Supply, the Voice of Distribution: http://www.contractorsupplymagazine.com/pages/Spre/Cable-Installation-Tools-Southwire-SIMpull-CoilPAK-Payoff-Spools.php, 1 page.

International Search Report dated Feb. 4, 2014, cited in Application No. PCT/US2013/069685; 13 pages.

Canadian Office Action dated Jun. 27, 2014, cited in Canadian Industrial Design Application No. 154768; 2 pages.

* cited by examiner

WIRE AND CABLE PACKAGE

CROSS-REFERENCE TO RELATED APPLICATIONS

The current application is a Continuation Application of and claims priority to U.S. application Ser. No. 14/077,998, entitled "WIRE AND CABLE PACKAGE," filed on Nov. 12, 2013, now U.S. Pat. No. 11,117,737, which claims the benefit of U.S. Provisional Patent Application No. 61/725,227, entitled "WIRE PACKAGE," filed on Nov. 12, 2012; and U.S. Provisional Patent Application No. 61/776,323, entitled "WIRE PACKAGE," filed on Mar. 11, 2013, all of which are hereby incorporated by reference in their entirety.

COPYRIGHTS

All rights, including copyrights, in the material included herein are vested in and the property of the Applicants. The Applicants retain and reserve all rights in the material included herein, and grant permission to reproduce the material only in connection with reproduction of the granted patent and for no other purpose.

BACKGROUND

With conventional systems, many electricians may be needed to install wire. One electrician would pull and feed the wire from a reel (i.e. spool) on an axle that has to be rotated to pay the wire off from the reel, one electrician would feed the wire and possibly lubricate the wire into a conduit, and a third electrician would pull the wire through the conduit. This method of installing wire is very labor intensive and strenuous as the electrician pulling wire from the reel holder may have to pull hard enough to overcome the stationary inertia to cause multiple reels holding 50 or more pounds of wire. For example, if there are seven reels with 50 pounds of wire on each reel, the electrician must pull with a force to overcome 350 pounds of stationary wire.

U.S. Pat. Nos. 2,620,997 and 3,390,844 disclose wire packages that can be used by an electrician to pay off wire for installation in commercial and residential buildings. The wire packages disclosed in these patents, however, do not withstand the conditions in which they may be used by an electrician in the field. These conditions may be simulated by tests that include the following steps, with each step performed ten times in succession: (a) sliding the package from side-to-side, (b) turning the package over, (c) dropping one horizontal edge of the package onto a hard surface from a height of two feet, (d) dropping the opposite horizontal edge of the package onto a hard surface from a height of two feet, and (e) dropping the opposite horizontal edge of the package onto a hard surface from a height of one foot. To pass these tests, the cable within the package should pay off without becoming tangled within the package after being subjected to these conditions at three points in time—when the package is 100% full, 50% full and 25% full.

When tested, the package disclosed in U.S. Pat. No. 2,620,997 failed these tests in each of ten attempts, and the package disclosed in U.S. Pat. No. 3,390,844 failed these tests in nine of ten attempts. The failures may be due to the packages breaking, or the cable within the packages becoming tangled such that it will not pay off correctly from the packages. Thus, there exists a need to develop a wire package that will withstand the conditions under which such packages are used by an electrician, while also overcoming the problem in the art of allowing a single electrician to pay off multiple wires at one time with less effort.

BRIEF DESCRIPTION OF THE DRAWINGS

The accompanying drawings, which are incorporated in and constitute a part of this disclosure, illustrate various embodiments of the present invention. In the drawings.

DESCRIPTION

Figure 1:
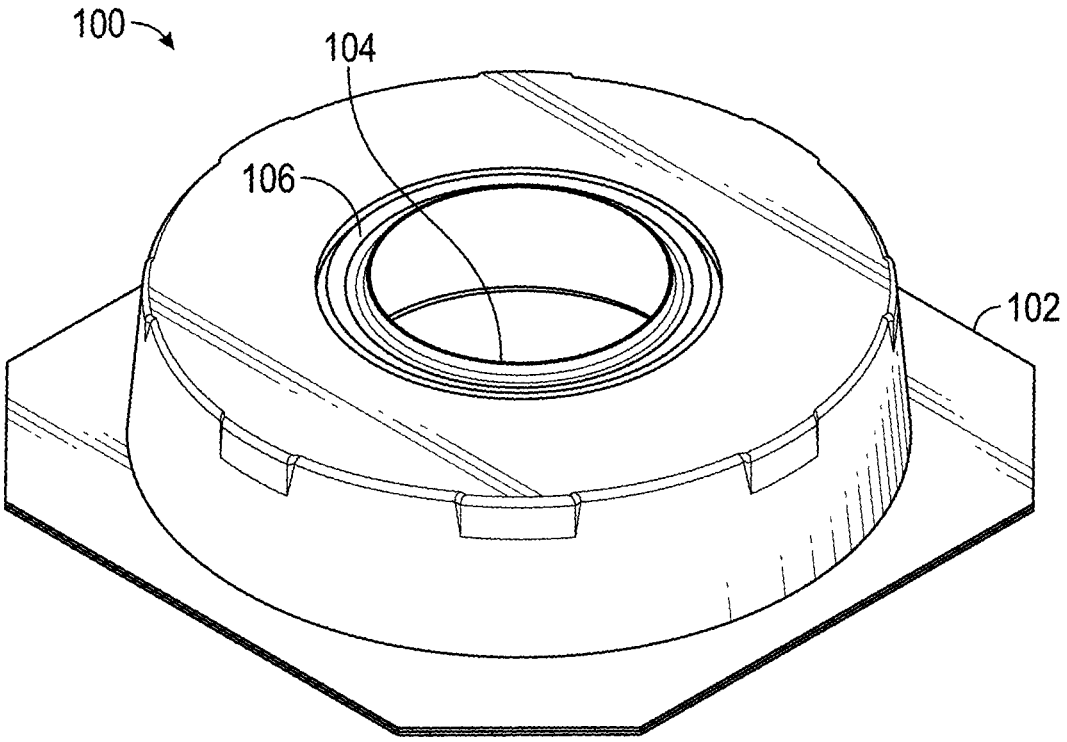
FIG. 1 shows a package.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention.

Consistent with embodiments of the invention, a cable package may be provided. The cable package may comprise a cable and a chamber. The cable may comprise a winding and at least one free end. The chamber may define an internal volume containing the cable. The chamber may comprise a continuous opening. The continuous opening may comprise at least one surface arranged to apply pressure to a portion of the cable located proximate to the continuous opening.

Figure 2:
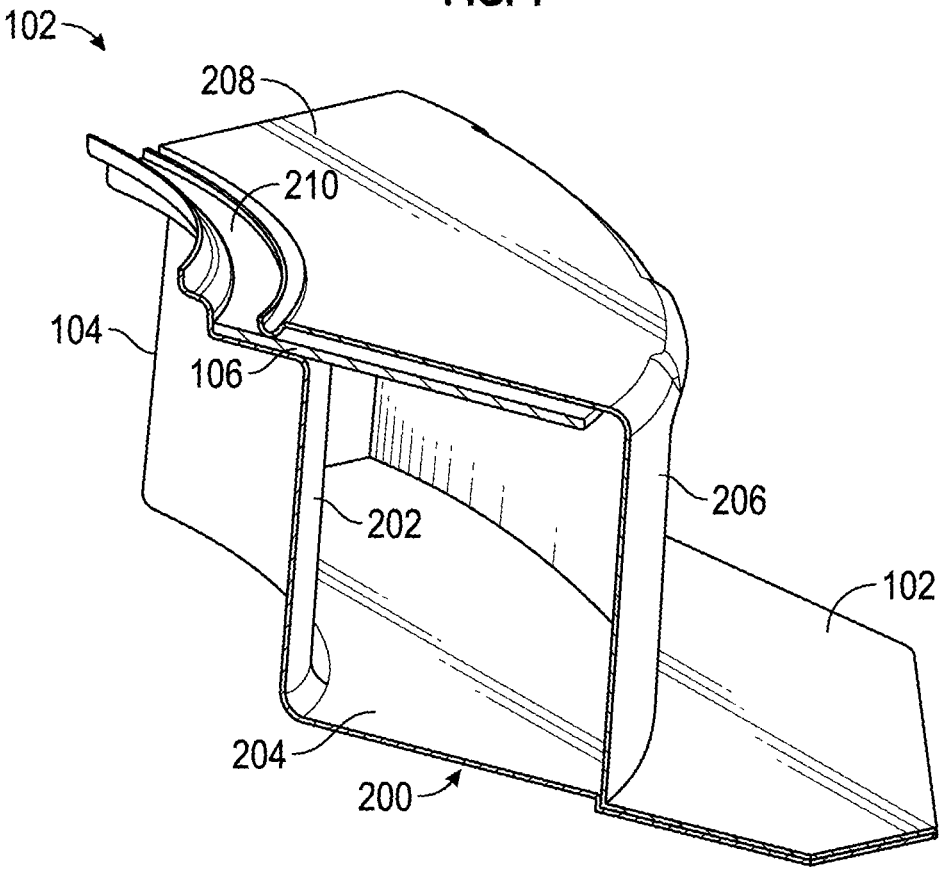
FIG. 2 shows a section of a package.

FIG. 1 shows a package 100. Package 100 may comprise a first piece 102, a second piece 104, and a partition 106. As shown in FIG. 2, first piece 102 and second piece 104 may form a chamber 200. Chamber 200 may define an internal volume. Chamber 200 may comprise an inner surface 202, a bottom surface 204, an outer surface 206, and a top surface 208. Top surface 208 and inner surface 202 may form a continuous opening 210. Continuous opening 210 may comprise at least one surface (e.g., top surface 208) arranged to apply pressure to a portion of a cable located proximate to continuous opening 210.

A portion of partition 106 may pass through continuous opening 210 and two mating surfaces may comprise the portion of partition 106 and a portion of top surface 208. For example, partition 106 may be located at least partially within chamber 200. In addition, partition 106 may divide chamber 200 into a first section and a second section. Partition 106 may be in the shape of a disk or other shapes. Partition 106 may be free to move or may be mounted in a fixed position.

First piece 102, second piece 104, and partition 106 may be manufactured from a polymer, metal, or both. First piece 102, second piece 104, and partition 106 may be manufactured via injection molding, rotational molding, vacuum forming, or stamping.

Figure 3:
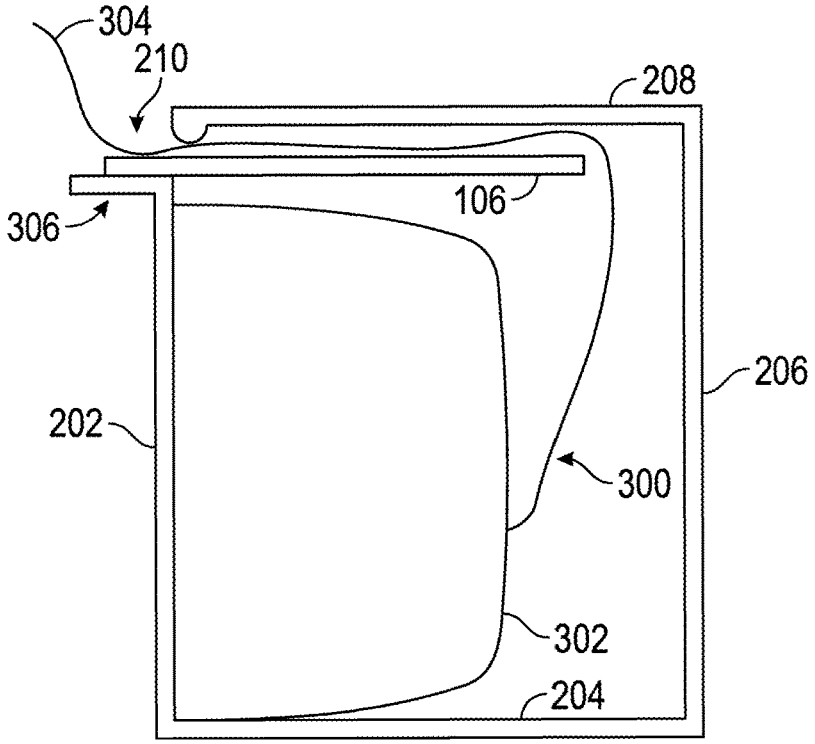
FIG. 3 shows a winding within a package.

As shown in FIG. 3, a cable 300 (either solid or stranded) may be located within chamber 200. Cable 300 may comprise a winding 302 and a free end 304. Winding 302 may be located within the first section and free end 304 may pass through the second section and out continuous opening 210. While FIGS. 1-3 show package 100 comprising partition 106, embodiments of package 100 may not comprise partition 106. Note that the word cable may be synonymous with the word wire.

Free end 304 may pass between partition 106 and top surface 208. In embodiments where package 100 does not comprise partition 106, continuous opening 210 may be formed by top surface 208 and inner surface 202. For example, inner surface 202 may comprise an angled portion 306. Top surface 208 and angled portion 306 may form continuous opening 210. Free end 304 may pass between top surface 208 and angled portion 306.

Continuous opening 210, whether formed by inner surface 202 and top surface 208 or top surface 208 and partition 106, may maintain a back tension on winding 302. Winding 302 may be wound tightly around inner surface 202. In other words, winding 302 may be wound around inner surface 202 such that winding 302's position or the position of the individual cables making up winding 302 do not change a significant amount during normal handling of package 100. The back tension may keep winding 302 from unwinding within chamber 200 when cable 300 is not being paid off from package 100.

Figure 4:
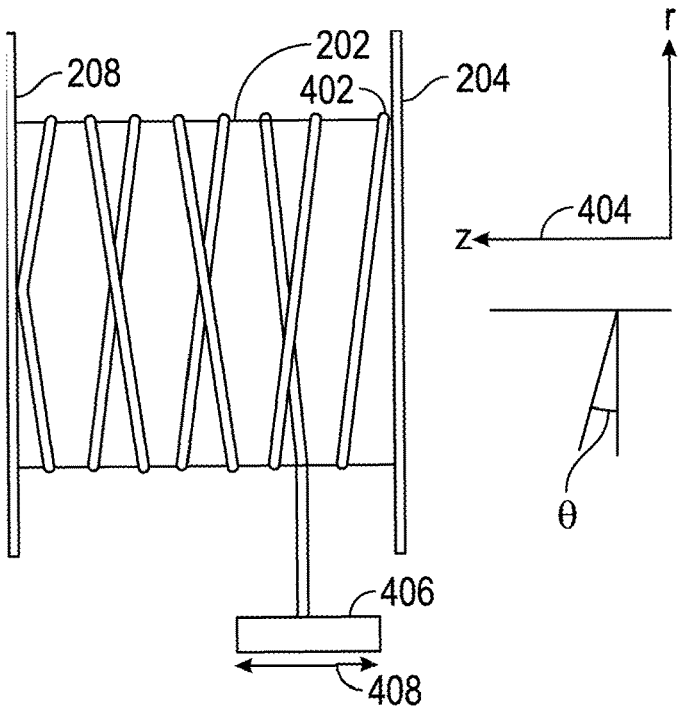
FIG. 4 shows a winding pattern within a package.

FIG. 4 shows stages for winding 302 being wound within package 100. Winding 302 may begin at a starting point 402. Winding 302 may be wound around inner surface 202 at an angle θ relative to an axis perpendicular to a central axis 404. During installation, second piece 104 may rotate about central axis 404. Cable 300 may feed from a head 406. Head 406 may oscillate along an axis parallel to central axis 404 as indicated by arrow 408. The oscillation of head 406 may cause cable 300 to lay on inner surface 202 at angle θ. Angle θ may range from approximately 2 degrees to approximately 85 degrees. Angle θ may be a function of cable 300's gauge and flexibility. In addition, angle θ may be a function of the curvature of inner surface 202. As cable 300 winds around inner surface 202, instead of forming a circle around inner surface 202, cable 300 may form an ellipse around inner surface 202. Furthermore, cable 300 may buildup in both the z and r directions simultaneously to form winding 302. In other words, as head 406 travels in a positive z direction a layer of cable 300 may be laid in both the z and r axis and as head 406 travels in a negative z direction another layer of cable 300 may be laid in both the z and r axis.

Furthermore, the characteristics of the specific cable 300 to be placed in a package 100, including the cable's composition and flexibility, will help determine the amount of cable 300 is placed in a package 100 the inner diameter of the winding 302 and the height of the winding 302.

After winding cable 300 onto inner surface 202, chamber 200 may be formed around winding 302. Free end 304 may be passed through continuous opening 210. Passing free end 304 through continuous opening 210 may comprise passing free end 304 from the first section around partition 106 to the second section. Cable 300 may be paid off from package 100 by passing free end 304 through continuous opening 210.

Figure 5:
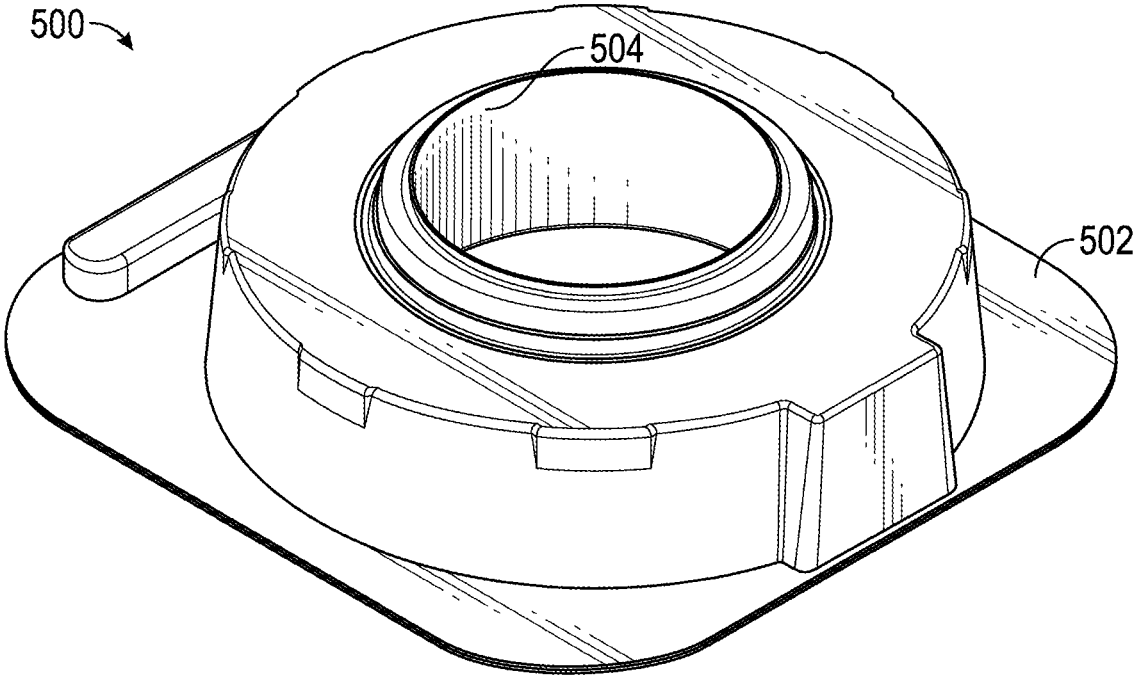
FIG. 5 shows a package.
Figure 6:
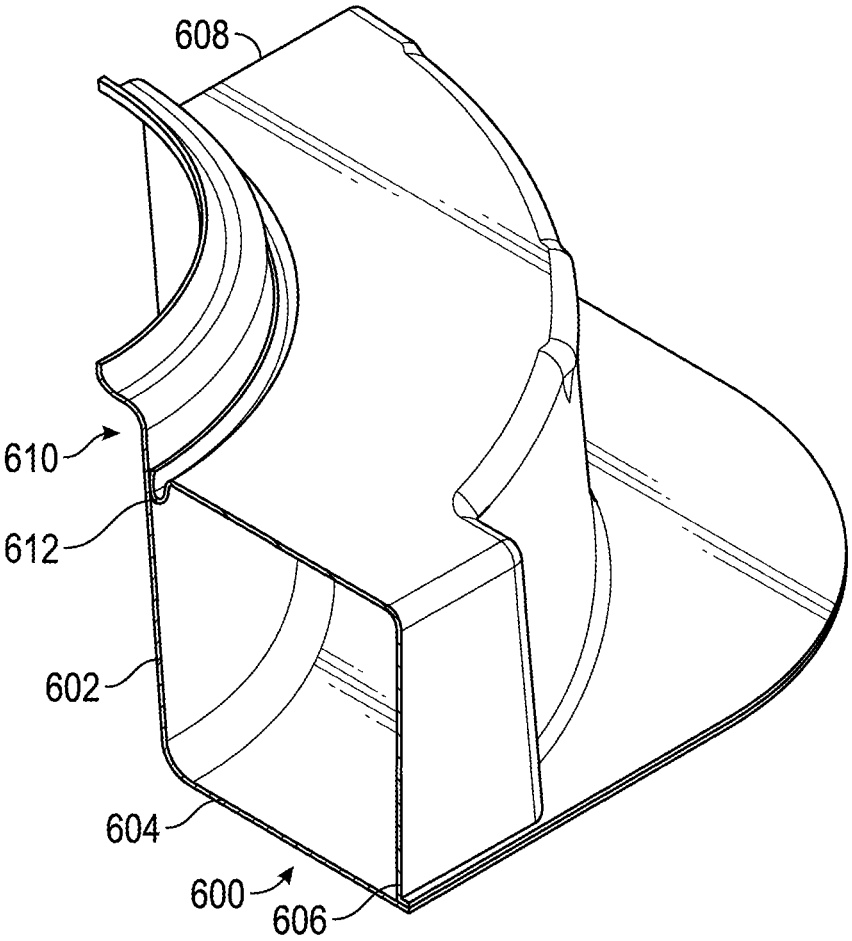
FIG. 6 shows a section of a package.

FIG. 5 shows a package 500. Package 500 may comprise a first piece 502 and a second piece 504. As shown in FIG. 6, first piece 502 and second piece 504 may form a chamber 600. Chamber 600 may define an internal volume. Chamber 600 may comprise an inner surface 602, a bottom surface 604, an outer surface 606, and a top surface 608. Top surface 608 and inner surface 602 may form a continuous opening 610. Continuous opening 610 may comprise at least one surface (e.g., top surface 608 or inner surface 602) arranged to apply pressure to a portion of a cable located proximate to continuous opening 610.

Top surface 608 may include a curved portion 612 that may be adjacent to inner surface 602. As shown in FIG. 6, top surface 608 may angled with respect to inner surface 602. Curved portion 612 may include an elongated section. The elongated section of curved portion 612 may allow for increased pressure on a cable 700 (see FIG. 7) between curved portion 612 and inner surface 602. The increased pressure may assist in keeping cable 700 from passing back into chamber 600. In addition, the angle of top surface 608 and the curved portion 612 may assist in keeping strands of winding 702 (see FIG. 7) from passing through continuous opening 610 until a proper tension is placed on free end 704 (see FIG. 7).

First piece 502 and second piece 504 may be manufactured from a polymer, metal, or both. First piece 502 and second piece 504 may be manufactured via injection molding, rotational forming, vacuum forming, thermoforming, or stamping.

Figure 7:
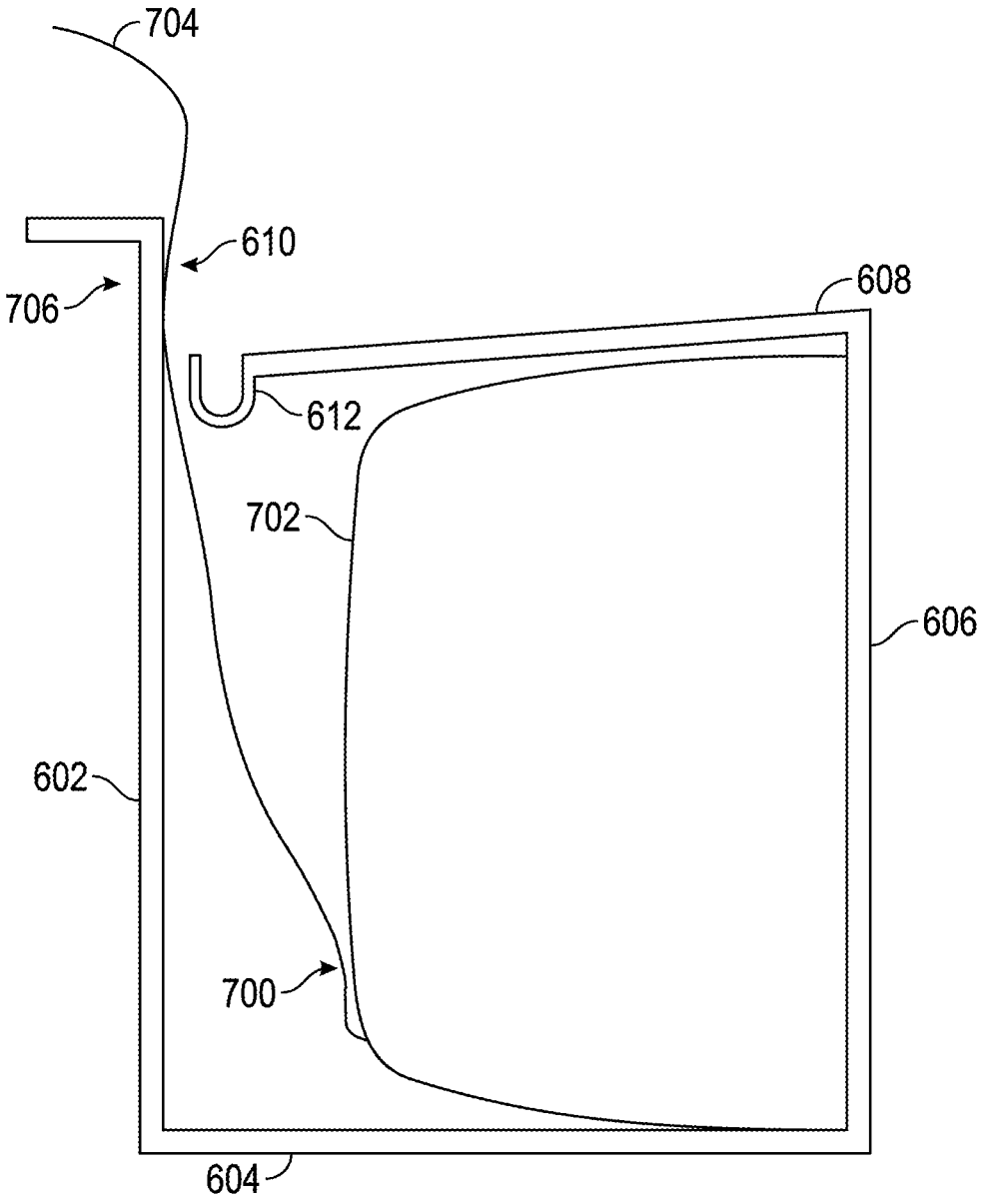
FIG. 7 shows a winding pattern within a package.

As shown in FIG. 7, a cable 700 (either solid or stranded cable) may be located within chamber 600. Cable 700 may comprise a winding 702 and a free end 704. Free end 704 may pass between inner surface 602 and top surface 608. A section 706 of inner surface 602 may protrude above top surface 608. Top surface 608 may rest against or be in close proximity to inner surface 602 (an exaggerated gap is shown in FIG. 7 for clarity). Inner surface 602 may form a tapered surface that may have a larger diameter proximate to bottom surface 604 and a smaller diameter proximate to decrease proximate top surface 608.

Continuous opening 610 may maintain a back pressure on winding 702. Winding 702 may be wound tightly against outer surface 606. In other words, winding 702 may be wound against outer surface 606 such that winding 702's position or the position of the individual cables making up winding 702 do not change a significant amount during normal handling of package 500. The back pressure may keep winding 702 from unwinding within chamber 600 when cable 700 is not being paid off from package 500. In other words, the back pressure created by continuous opening 610 may cause winding 702 to remain against outer surface 606 and not collapse onto inner surface 602.

Figure 8:
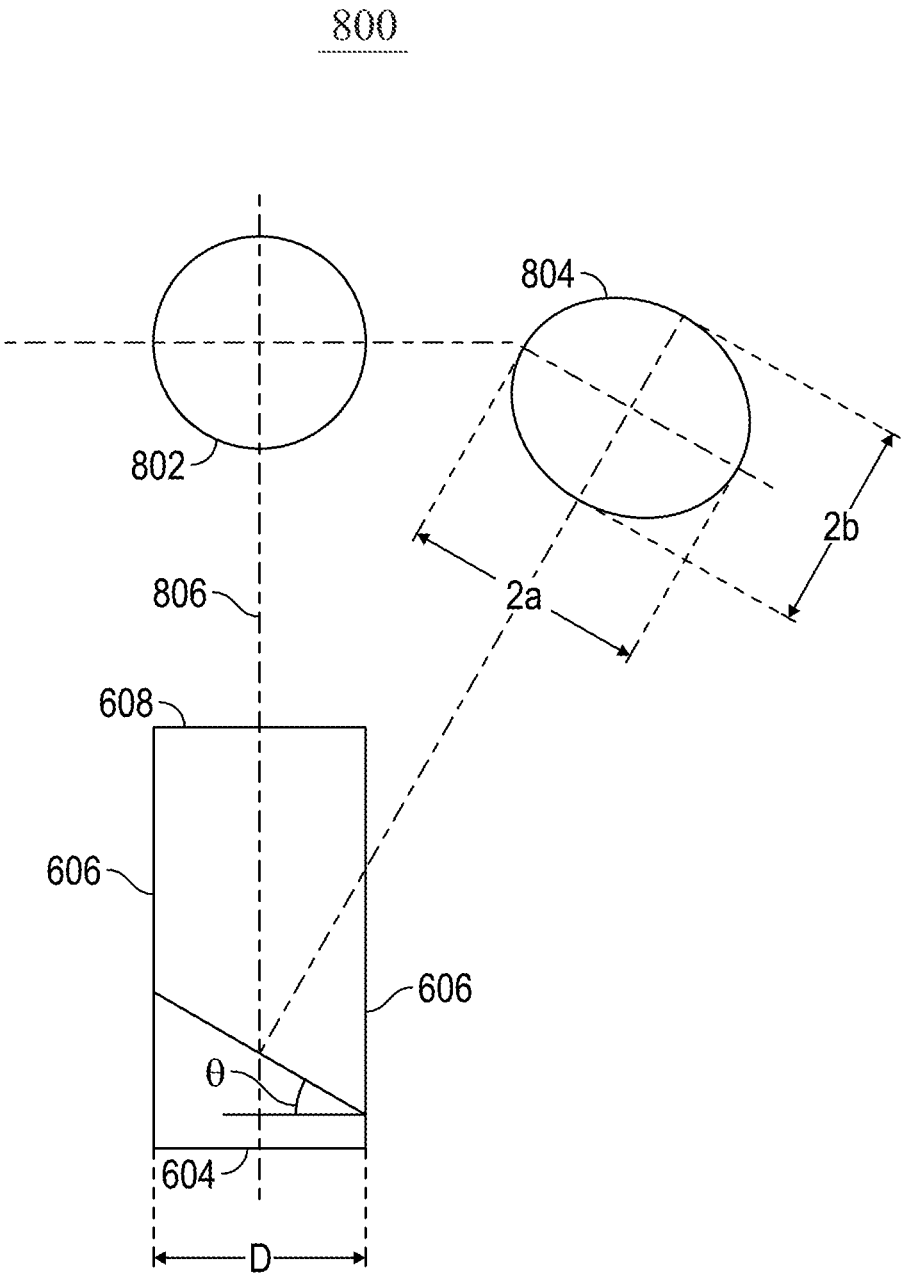
FIG. 8 shows a shows a schematic for calculating a circumference of a winding.

FIG. 8 shows a schematic 800 for calculating a circumference of winding 702. Because winding 702 may be wound at angle θ, the circumference of the wiring comprising winding 702 along the perimeter of package 500 may not form a circle (as shown by a top view 802), it may form an ellipse (as shown by projection 804). Package 500 may have a diameter D. The ellipse formed by the individual wires within winding 702 may have a major axis with a length:

$$2a = \frac{D}{\cos\theta} \quad \text{(Eqn. I)}$$

Where a is half the length of the major axis, D is the diameter of package 500, and θ is the angle of the strands of winding 702 relative to the central axis 806 of package 500.

The circumference C of the ellipse may be calculated as:

$$C_{ellipse}-4aE(e) \quad \text{(Eqn. II)}$$

Where E(e) is a complex elliptical integral of the second kind and e is the eccentricity of the ellipse e may be given by the formula:

$$e=\sqrt{\frac{a^2-b^2}{a^2}}=\sqrt{1-\left(\frac{b}{a}\right)^2} \quad \text{(Eqn. III)}$$

Where b is D/2 (i.e., the radius.

Substituting an approximation for the infinite series that results from the complex elliptical integral of the second kind may result in the circumference of a strand of winding 702 proximate outer surface 606 that may be approximated as:

$$C_{ellipse}\approx\pi(a+b)\left(1+\frac{3\left(\frac{a-b}{a+b}\right)^2}{10+\sqrt{4-3\left(\frac{a-b}{a+b}\right)^2}}\right) \quad \text{(Eqn. IV)}$$

The circumference of package 500 (e.g., outer surface 606 proximate winding 702) may be:

$$C_{package\ 500}=\pi D \quad \text{(Eqn. V)}$$

$C_{ellipse}$ is greater than $C_{package\ 500}$ when 2b=D. Therefore, for a rigid container (i.e., package 500), the length of each revolution of wire in winding 702 may be greater than the circumference of the surface constraining each revolution of wire in winding 702 (i.e., outer surface 606). As a result, the wire in winding 702 may not lay flat on bottom surface 604. In other words, the length of each revolution of wire within winding 702 may cause the wires within winding 702 to maintain a stable position within package 500 and not collapse onto each other. The stability of winding 702 may be maintained even when winding 702 comprises a wire having a lubricated jacket (i.e., SIMpull® wire). In addition, the stability of winding 702 may be maintained during normal handling of package 500. For example, winding 702 may maintain its shape and position when package 500 slides side-to-side, turns in any direction or is dropped. Indeed the winding inside the packages disclosed herein pass the tests discussed above that simulate the conditions in which the packages may be used by an electrician in the field.

Winding 702 may be constrained on three sides. For example, winding 702 may be constrained by outer surface 606, top surface 608, and bottom surface 604. Due to cable 700 being laid at angle θ, the three sides may each apply a pressure to winding 702. The three sides may act to constrain winding 702's movement by applying a pressure that does not exceed the yield point of the packaging material. Winding 702 also may be constrained due to its lay pattern and geometry. The constraining of winding 702's movement may allow package 500 to be moved, even after portions of cable 700 have been paid off of winding 702, without winding 702 becoming tangled within package 500.

Winding 702 being constrained by bottom surface 604, outer surface 606, and top surface 608 may include winding 702 being in close proximity to bottom surface 604, outer surface 606, and top surface 608. In other words, winding 702 may be substantially close to bottom surface 604, outer surface 606, and top surface 608 such that during movement of package 500 winding 702 may retain its shape and position within chamber 600.

Winding 702 may comprise a solid or stranded cable or wire. Constraining winding 702 may provide stability. For instance, if winding 702 is a stranded wire or other wire with an increased flexibility, having winding 702 constrained may allow for portions of winding 702 to be paid off from package 500 while still allowing winding 702 to maintain its shape and resist tangling. For example, an electrician may use 50% or 75% of the wire within package 500 and due to winding 702 being constrained, the electrician may then be able to move package 500 without winding 702 becoming tangled or otherwise unusable.

The wire or cable may include a jacket that may comprise lubrication integrated into the jacket. For example, the wire or cable may be SIMPULL® wire manufactured by SOUTHWIRE® Company of Carrollton, Georgia. Alternatively, the wire or cable may include a jacket that does not comprise lubrication integrated into the jacket, and, in such cases, lubrication may be integrated into the package 500.

A rigid container may be a container that maintains a cylindrical shape as the size of winding 702 decreases. In other words, a rigid container may be a container that maintains its shape and have a constant cylindrical profile as wire is paid off from the rigid container. The rigid container may also be tear and puncture resistant.

Figure 9:
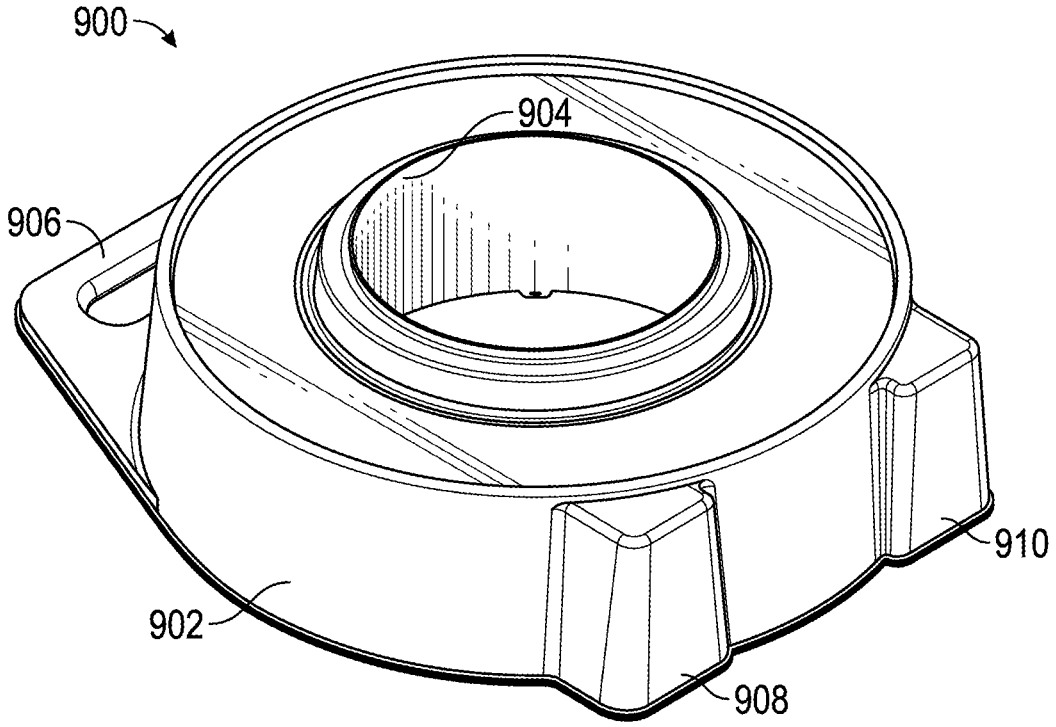
FIG. 9 shows a package.

FIG. 9 shows a package 900. Package 900 may comprise a first piece 902 and a second piece 904. First piece 902 and/or second piece 904 may form a handle 906 and a first support 908 and a second support 910. First support 908 and second support 910 may allow package 900 to stand upright in addition to laying flat.

Figure 10:
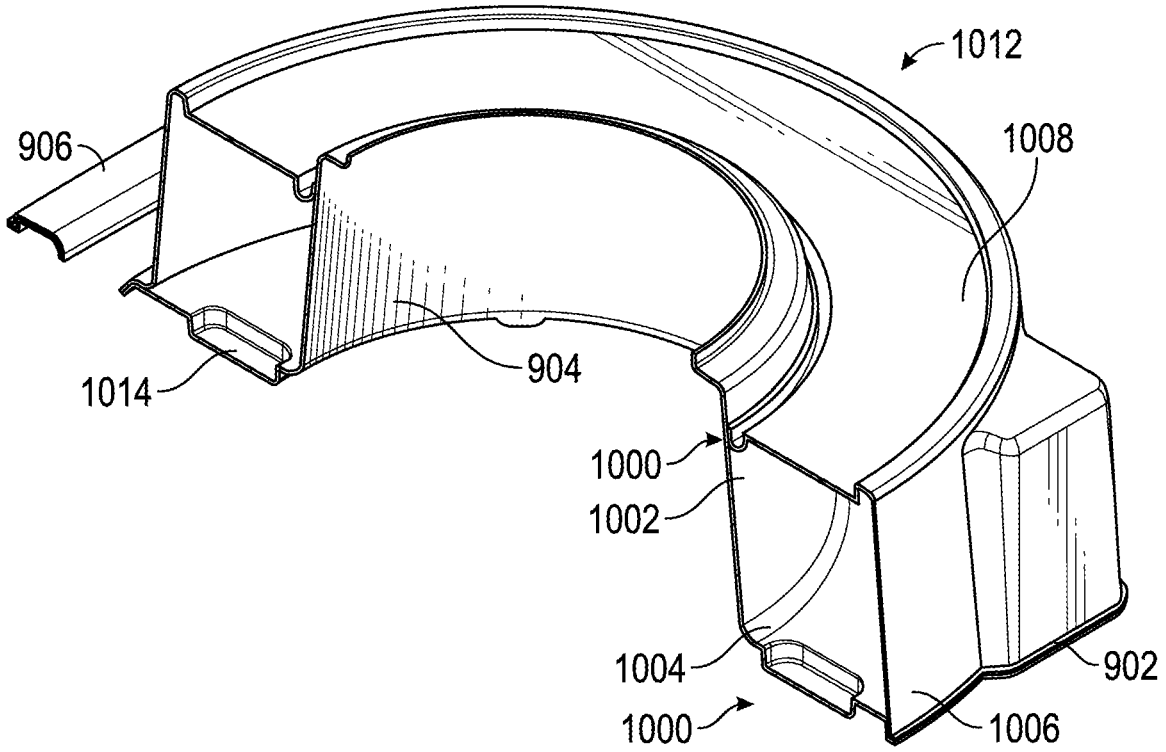
FIG. 10 shows a section of a package.

As shown in FIG. 10, first piece 902 and second piece 904 may form a chamber 1000. Chamber 1000 may define an internal volume. Chamber 1000 may comprise an inner surface 1002, a bottom surface 1004, an outer surface 1006, and a top surface 1008. Top surface 1008 and inner surface 1002 may form a continuous opening 1010. Continuous opening 1010 may comprise at least one surface (e.g., top surface 1008 or inner surface 1002) arranged to apply pressure to a portion of a cable located proximate to continuous opening 1010.

Top surface 1008 may comprise a recessed portion 1012. Bottom surface 1004 may comprise a protrusion 1014. As shown in FIG. 10, recessed portion 1012 may be continuous. In addition, recessed portion 1012 may comprise discrete recessed portions. As shown in FIG. 10, protrusion 1014 may comprise discrete protrusions. In addition, protrusion 1014 may comprise a continuous protrusion.

First piece 902 and second piece 904 may be manufactured from a polymer, metal, or both. First piece 902 and second piece 904 may be manufactured via injection molding, rotational molding, vacuum forming, or stamping. Wire or cable may be located within chamber 1000 and pay off from package 900 as described above with respect to FIGS. 7 and 8.

Continuous opening 1010 may maintain a back pressure on winding 702. Winding 702 may be wound tightly against outer surface 1006. In other words, winding 702 may be wound against outer surface 1006 such that winding 702's position or the position of the individual cables making up winding 702 do not change a significant amount during normal handling of package 900. The back pressure may keep winding 702 from unwinding within chamber 1000 when cable 700 is not being paid off from package 900. In other words, the back pressure created by continuous opening 1010 may cause winding 702 to remain against outer surface 1006 and not completely collapse onto inner surface 1002.

Figure 11:
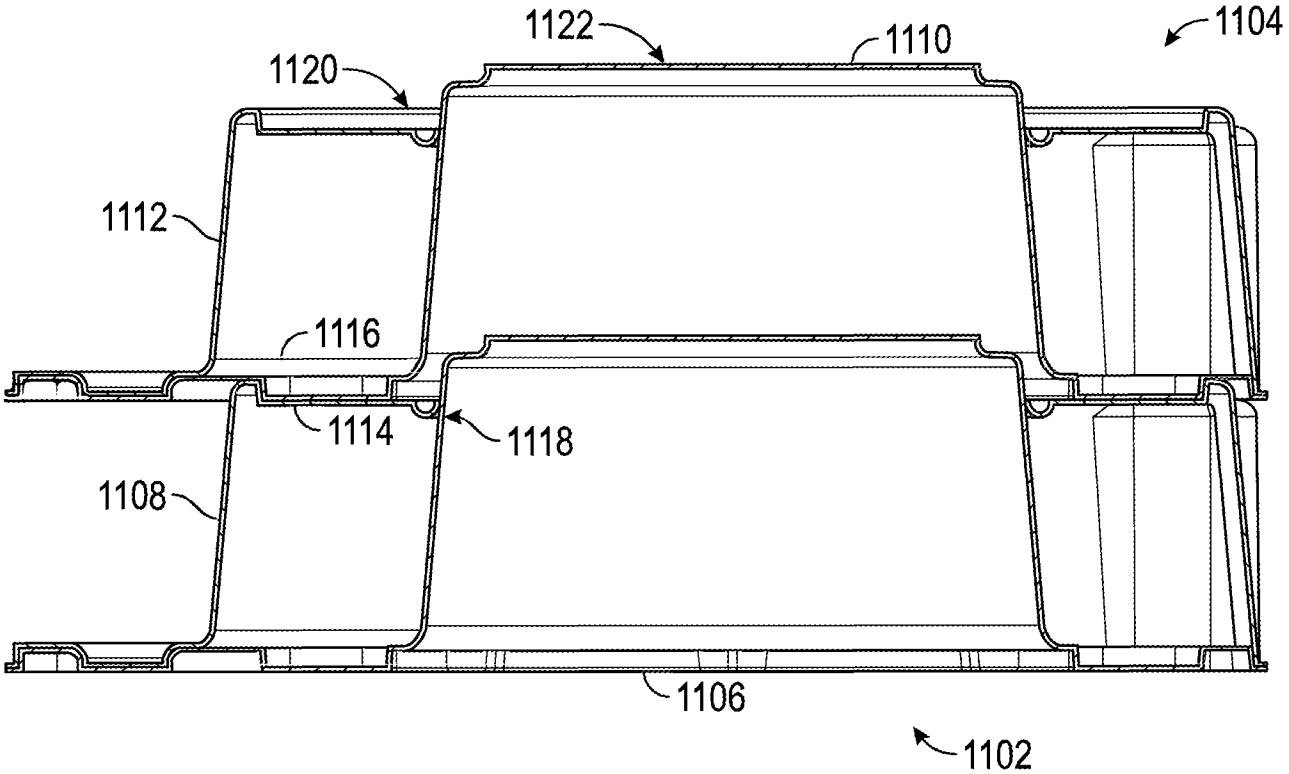
FIG. 11 shows stackable packages.

FIG. 11 shows stackable packages. The stackable packages may comprise a first package 1102 and a second package 1104. First package 1102 may comprise a first piece 1106 and a second piece 1108. Second package 1104 may comprise a third piece 1110 and a fourth piece 1112.

As described above with respect to FIG. 10, second piece 1108 may comprise a recess 1114 and third piece 1110 may comprise a protrusion 1116. During use, an electrician or other user may stack first package 1102 and second package 1104. Recess 1114 and protrusion 1116 may be used to maintain an alignment between first package 1102 and second package 1104.

Wire may feed from a first continuous opening 1118 and a second continuous opening 1120. The wire from first package 1102 may feed through a center core 1122 of second package 1104. In addition, more than two packages may be stacked. For example, an electrician may need five wires and therefore may stack five packages. Furthermore, while FIGS. 1-11 describe windings comprising a single wire, embodiments may comprise windings including multiple wires. For example, winding 700 may comprise two wires laid in parallel. Furthermore, first piece 1106 can be stacked or nested on top of other first pieces 1106 during storage or transportation. Likewise, second piece 1108 can be stacked or nested on top of other second pieces 1008 during storage or transportation.

Figure 12:
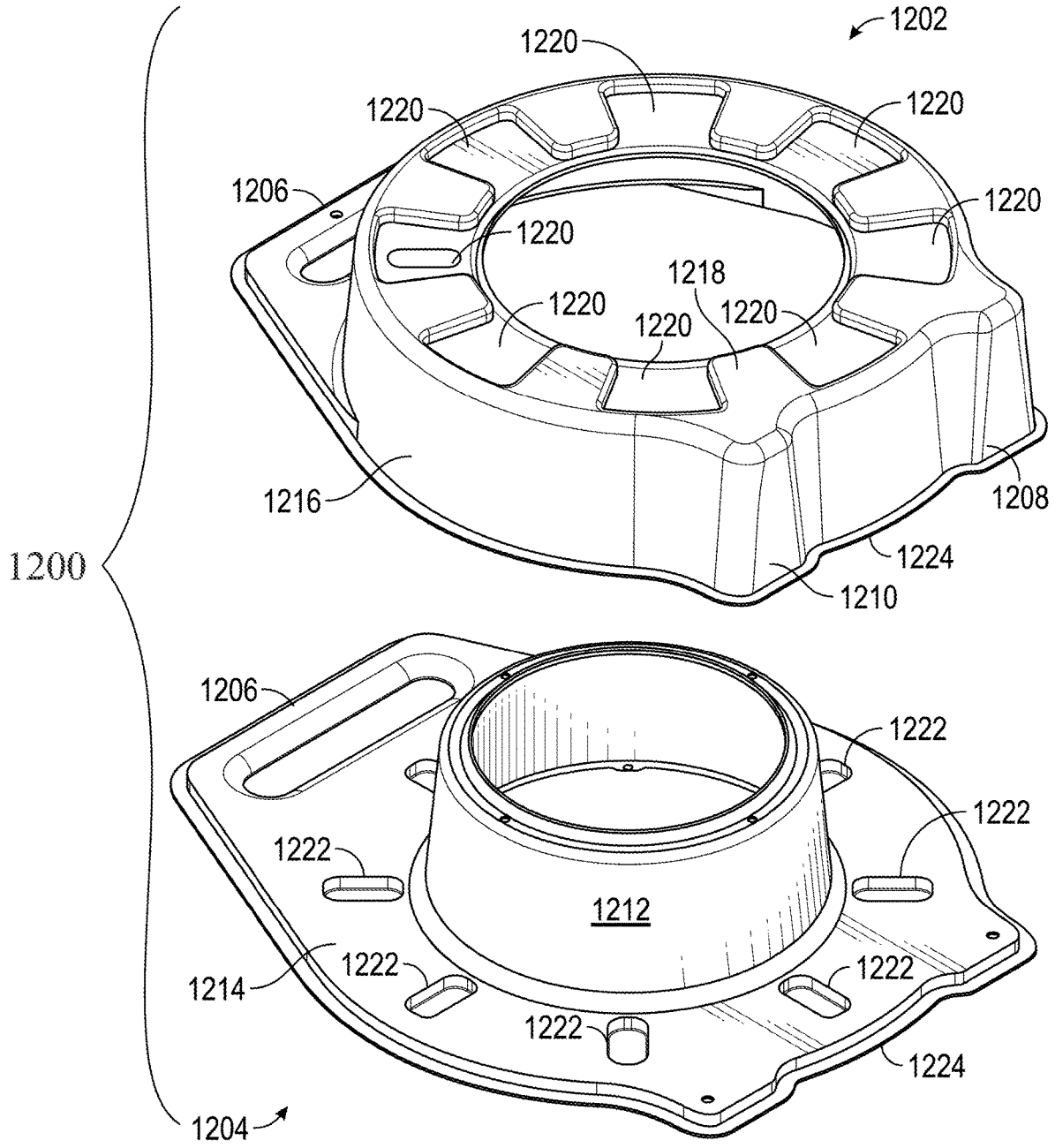
FIG. 12 shows a package.

FIG. 12 shows a package 1200. Package 1200 may comprise a first piece 1202 and a second piece 1204. First piece 1202 and/or second piece 1204 may form a handle 1206 and a first support 1208 and a second support 1210. First support 1208 and second support 1210 may allow package 1200 to stand upright in addition to lying flat.

First piece 1202 and second piece 1204 may form a chamber. The chamber may define an internal volume. The chamber may comprise an inner surface 1212, a bottom surface 1214, an outer surface 1216, and a top surface 1218. Top surface 1218 and inner surface 1212 may form a continuous opening, such as continuous opening 1010 shown in FIG. 10. The continuous opening may comprise at least one surface (e.g., top surface 1218 or inner surface 1212) arranged to apply pressure to a portion of a cable located proximate to the continuous opening.

Top surface 1218 may comprise a plurality of recessed portions 1220. Bottom surface 1214 may comprise a plurality of protrusions 1222. Plurality of recessed portions 1220 may be discrete in size. Plurality of protrusions 1222 may comprise discrete protrusions.

First piece 1202 and second piece 1204 may be manufactured from a polymer, metal, or both. First piece 1202 and second piece 1204 may be manufactured via injection molding, rotational molding, vacuum forming, thermoforming, or stamping. Wire or cable may be located within the chamber and pay off from package 1200 as described above with respect to FIGS. 7 and 8.

The continuous opening may maintain a back pressure on winding 702. Winding 702 may be wound tightly against outer surface 1216. In other words, winding 702 may be wound against outer surface 1216 such that winding 702's position or the position of the individual cables making up winding 702 do not change a significant amount during normal handling of package 1200. The back pressure may keep winding 702 from unwinding within the chamber when cable 700 is not being paid off from package 1200. In other words, the back pressure created by the continuous opening may cause winding 702 to remain against outer surface 1216 and not completely collapse onto inner surface 1212.

First piece 1202 and second piece 1204 may be connected with a hinge 1224. Hinge 1224 may allow first piece 1202 and second piece 1204 to open so a replacement winding may inserted into package 1200. In other words, hinge 1224 may allow package 1200 to be reusable by an end user. Alternatively, first piece 1202 and second piece 1204 may be connected using twist locks, snaps, pins, rivets, heat bonding, thermal bonding or some similar mechanism or technique. Any of these types of connections also may allow first piece 1202 and second piece 1204 to open so a replacement winding may be inserted into package 1200.

The various packages may be manufactured from various materials and may be of varying thicknesses. For example, the material thickness may range from 30 mils to 60 mils. The material may be, for example, a PVC, polyethylene, or any polymer having a high molecular weight. The combination of material and material thickness may be dependent on the operating environment. For example, in a cold climate, a material with a high molecular weight may be used to help combat brittleness. In a warm climate, a thicker material with a lower molecular weight may be used. In addition the material may be clear or semi-transparent to allow a user to see and/or determine how much wire is remaining in the package.

Figure 13A:
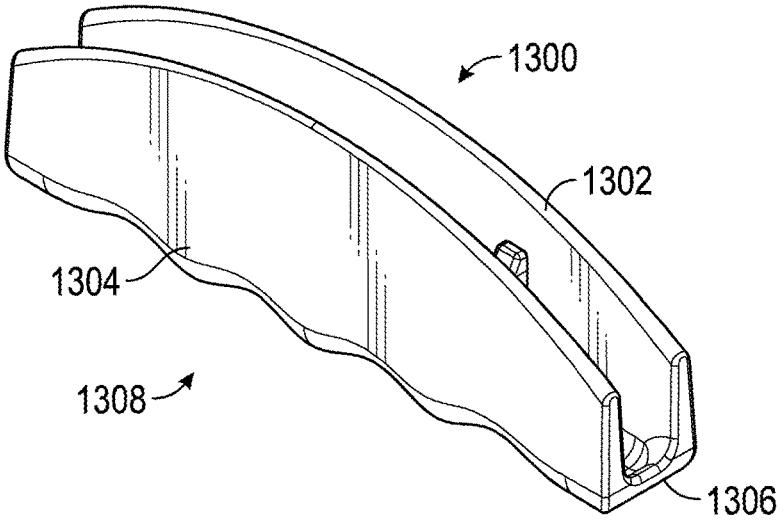
FIGS. 13A, 13B, and 13C show a handle.
Figure 13B:
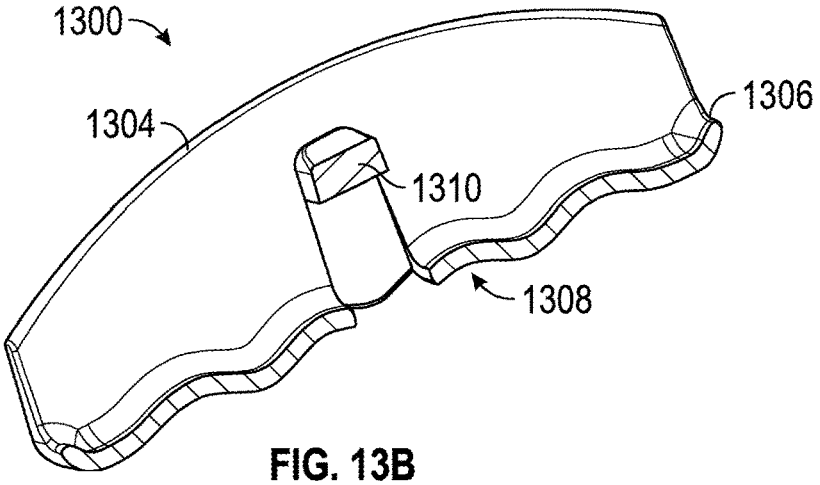
Figure 13C:
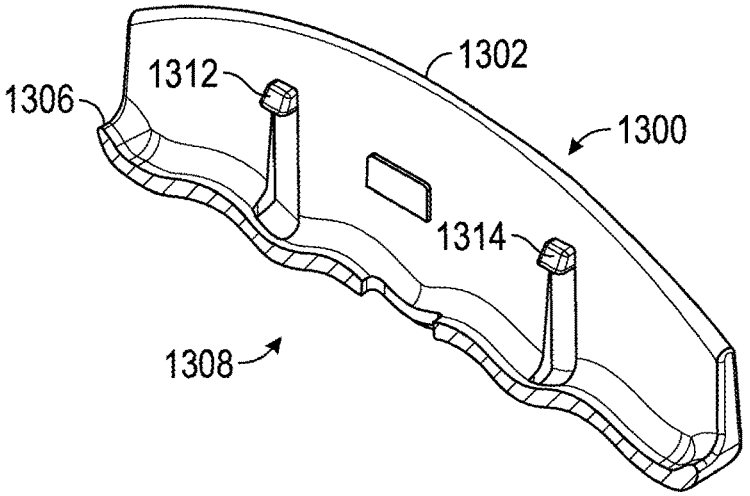

FIGS. 13A, 13B, and 13C show a handle 1300. Handle 1300 may comprise a first side 1302, a second side 1304, and a bottom 1306. First side 1302, second side 1304, and bottom 1306 may form a U-shape profile. A grip (e.g., handle 1206) may rest within the U-shape profile. Handle 1300 may increase comfort for a user. For instance, bottom 1306 may increase a bearing surface against the user's hand while carrying package 1200. In addition, bottom surface 1306 may have a plurality of curves 1308. Plurality of curves 1308 may conform to the user's fingers. In addition, padding may be provided on handle 1300 (e.g., along bottom 1306) to increase user comfort.

Handle 1300 may be part of or attached to first piece 1202 of package 1200, second piece 1204 of package 1200, or both. To facilitate attaching handle 1300 to a package, first side 1302 may include a first prong 1310. Second side 1304 may include a second prong 1312 and a third prong 1314. The prongs may engage indentions located on the package. In addition, the prongs may include a tacky substance (e.g., an adhesive or grip tape) to facilitate securing handle 1300 to the package.

Handle 1300 may be manufactured by injection molding, rotational molding, thermoforming, or other manufacturing techniques. Once handle 1300 is formed, any tacky substance used to facilitate securing handle 1300 to the package may be applied. In addition, during manufacturing grooves may be formed in first prong 1310, second prong 1312, and third prong 1314.

Figure 14:
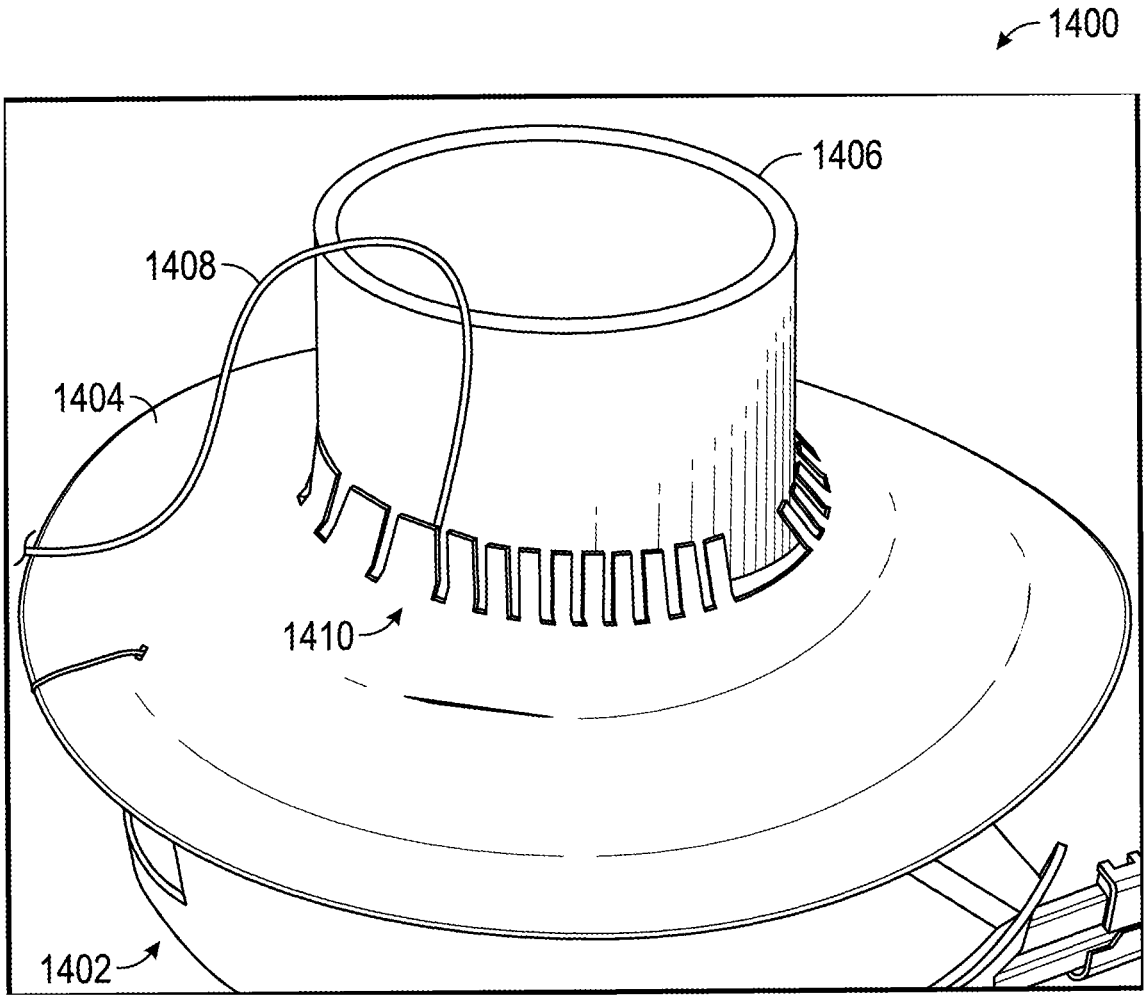
FIG. 14 shows a package.

FIG. 14 shows a package 1400. Package 1400 may comprise a lower section 1402, an upper section 1404, and a center section 1406. Center section 1406 may pass through upper section 1404 and may form an opening for a wire 1408 to pass through. Upper section 1404 may comprise a plurality of tines 1410. Plurality of tines 1410 may be flexible. A wire 1408 may pass from lower section 1402 and between center section 1406 and upper section 1404 (i.e., through the opening). As wire 1408 is paid off from package 1400, plurality of tines 1410 may conform around wire 1408. The conformity may apply a pressure to wire 1408. The pressure may assist in keeping a winding located within lower section 1402 from unraveling. In addition, the pressure may help keep wire 1408 from falling back into lower section 1402.

Consistent with embodiments of the invention, a method of manufacturing a cable package may be provided. The cable package may comprise a cable and a chamber. The chamber may be formed by connecting a first piece and a second piece. The first piece and second piece may be manufactured via injection molding, rotational molding, vacuum forming, or stamping.

A cable may be wound into a winding, and the cable may have a free end. The winding may be wound around a reel at an angle θ relative to an axis perpendicular to a central axis of the reel. During installation, the reel may rotate about a central axis. A cable may feed from a head. The head may oscillate along parallel to the central axis, and the oscillation of the head may cause a cable to lay on the reel at angle θ. Angle θ may range from approximately 2 degrees to approximately 85 degrees. Angle θ may be a function of a cable's gauge and flexibility. In addition, angle θ may be a function of the curvature of the reel. As a cable winds around the reel, instead of forming a circle around the reel, a cable may form one or more ellipses around the reel. Furthermore, as discussed in embodiments above, a cable may buildup in both the z and r directions simultaneously to form a winding.

A winding formed on a reel may then be removed from the reel and placed onto the second piece of a package. Alternatively, the winding may be formed directly onto an inner surface of the second piece using the steps discussed above.

Once a winding is in place, the first piece and the second piece may be connected together to form a chamber. The first piece and the second piece may be connected with a hinge, twist locks, snaps, pins, rivets, heat bonding, thermal bonding or some similar mechanism or technique. The connection between a first piece and a second piece may be arranged to allow a first piece and a second piece to open so a replacement winding may be inserted into a package.

The connection of a first piece and a second piece may be arranged to form a continuous opening between a first piece and a second piece, and a free end of a cable may pass through the continuous opening.

A handle may be manufactured as part a first piece of a package, a second piece of a package or both. Alternatively, a handle may be attached to a first piece of a package, a second piece of a package or both. A handle may be manufactured by injection molding, rotational molding, thermoforming, or other manufacturing techniques.

While certain embodiments of the invention have been described, other embodiments may exist. While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as examples for embodiments of the invention.

What is claimed is:

1. A package comprising:

a chamber defining an internal volume, the chamber comprising an inner surface, an outer surface, a top surface and a bottom surface, and a central axis parallel to the inner surface, wherein the inner surface comprises a curvature and the chamber comprises a circular diameter; and a cable comprising a winding and at least one free end, the winding contained within the chamber and constrained by the inner surface, the outer surface, the top surface and the bottom surface, wherein the winding is wound around the inner surface and is oriented within the chamber by laying the cable at a winding angle in an oscillating manner, the winding angle being defined by the angle of the cable relative to a second axis oriented perpendicular to the central axis such that the winding forms an ellipse around the inner surface, wherein a diameter of the ellipse formed by the winding of the cable is greater than the circular diameter formed by the chamber, and wherein the elliptical shape of the winding minimizes the movement of the winding within the chamber.

2. The package of claim 1, wherein the winding angle is between 2° and 85°.

3. The package of claim 1, wherein the at least one free end pays off from a portion of the winding proximate an inner surface of the winding.

4. The package of claim 1 comprising the cable comprising the winding, wherein laying the cable at the winding angle in an oscillating manner further comprises a head moving parallel to the central axis, such that the cable is laid at a first winding angle when the head moves in a first direction parallel to the central axis, and the cable is laid at a second winding angle when the head moves in a second direction, opposite the first direction and parallel to the central axis.

5. The package of claim 1, wherein the cable comprises a stranded cable.

6. The package of claim 1, wherein the cable comprises a solid cable.

7. The package of claim 1, wherein the cable comprises a jacket including an integrated lubrication.

8. A package comprising:

a chamber defining an internal volume, the chamber comprising an inner surface, an outer surface, a top surface and a bottom surface, wherein the inner surface comprises a curvature; and a cable comprising a winding and at least one free end, the winding contained within the chamber and constrained by the outer surface, the top surface and the bottom surface, wherein the length of each revolution of the cable in the winding is greater than the circumference of the outer surface so as to minimize the movement of the winding within the chamber.

9. The package of claim 8, wherein a circular continuous gap is formed by an opening between an edge of the inner surface and an edge of the top surface.

10. The package of claim 9, wherein the circular continuous gap formed by the opening between the edge of the inner surface and the edge of the top surface is arranged to apply back tension to the winding of the cable passing through the continuous gap so as to minimize the movement of the winding within the chamber.

11. The package of claim 10, wherein the edge of the inner surface that forms the circular continuous gap comprises tines that apply at least a part of the back tension to the winding.

12. The package of claim 10, wherein the edge of the top surface that forms the circular continuous gap comprises tines that apply at least a part of the back tension to the winding.

13. The package of claim 8, further comprising protrusions and/or recesses that allow the package to be stacked with another package.

14. The package of claim 13, wherein the protrusions and/or recesses may be used to maintain an alignment between the stacked packages.

* * * * *